US007849628B2

(12) United States Patent
Condon et al.

(10) Patent No.: US 7,849,628 B2
(45) Date of Patent: Dec. 14, 2010

(54) RIFLE LAUNCHER FOR SMALL UNMANNED AERIAL VEHICLES (UAVS)

(75) Inventors: John A. Condon, Timonium, MD (US); Timothy Brosseau, Havre De Grace, MD (US); David Lyon, Street, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 521 days.

(21) Appl. No.: 11/856,049

(22) Filed: Sep. 16, 2007

(65) Prior Publication Data

US 2010/0281745 A1 Nov. 11, 2010

Related U.S. Application Data

(60) Provisional application No. 60/846,620, filed on Sep. 22, 2006.

(51) Int. Cl.
*F41C 27/06* (2006.01)

(52) U.S. Cl. ..... 42/105

(58) Field of Classification Search ..... 89/1.34; 42/105

See application file for complete search history.

(56) References Cited

U.S. PATENT DOCUMENTS 1,418,964 A * 6/1922 Norman ..... 89/1.34
2,700,839 A * 2/1955 Finlay et al. ..... 42/79
3,619,924 A * 11/1971 Paine ..... 42/105
3,981,093 A 9/1976 Reed
3,999,461 A * 12/1976 Johnson et al. ..... 89/191.01
4,270,293 A * 6/1981 Plumer et al. ..... 42/105
4,930,242 A 6/1990 Bialy
6,576,880 B2 * 6/2003 Martorana et al. ..... 244/3.1
6,688,032 B1 2/2004 Gonzalez et al.
2003/0110675 A1 * 6/2003 Garrett et al. ..... 42/85
2003/0192223 A1 * 10/2003 Sharp ..... 42/94

FOREIGN PATENT DOCUMENTS

WO WO2006091240 A2 8/2006

* cited by examiner

*Primary Examiner*—Stephen M Johnson
(74) *Attorney, Agent, or Firm*—Richard A. Morgan; William V. Adams; Christos S. Kyriakou

(57) ABSTRACT

A launcher system and method for an unmanned aerial vehicle (UAV), wherein the launcher system comprises a barrel comprising a prepackaged internal pusher cup configured behind the UAV housed within the barrel; an expansion chamber operatively connected around the barrel, wherein the barrel extends out of a first end of the expansion chamber; a muzzle adapter operatively connected to a second end of the expansion chamber, wherein the first end of the expansion chamber is positioned opposite to the second end of the expansion chamber; a rifle slip-fitted to the muzzle adapter; and a stand operatively connected to the expansion chamber, wherein a triggering of the rifle causes the internal pusher cup to push the UAV out of the barrel at a predetermined launch velocity in order to attain a predetermined self-propelled flight trajectory.

20 Claims, 4 Drawing Sheets

RIFLE LAUNCHER FOR SMALL UNMANNED AERIAL VEHICLES (UAVS)

CROSS-REFERENCE TO RELATED APPLICATIONS

This application claims the benefit of U.S. Provisional Patent Application No. 60/846,620 filed on Sep. 22, 2006 and entitled "Rifle Launcher for Small Unmanned Aerial Vehicles (UAVs)," the complete disclosure of which, in its entirety, is herein incorporated by reference.

GOVERNMENT INTEREST

The embodiments described herein may be manufactured, used, and/or licensed by or for the United States Government without the payment of royalties thereon.

BACKGROUND

1. Technical Field

The embodiments herein generally relate to weapon deployment systems, and, more particularly, to weapon deployment systems used on small unmanned aerial vehicles (UAVs).

2. Description of the Related Art

Unmanned Aerial Vehicles (UAVs) are typically used in military operations such as for surveillance. Typical launchers used for UAVs are generally large, cumbersome, or costly to use, and sometimes require multiple people to operate and require special handling for proper deployment. Conventional launchers for launching small "fixed-wing" UAV's in the military include hydraulic/electric rail guns, elastic band type launchers, pneumatic launchers, and hand launchers. However, there remains a need for a novel weapons launcher for small UAVs capable of being used by one person in a simple and cost effective manner.

SUMMARY

In view of the foregoing, an embodiment provides a launcher system for a UAV, wherein the launcher system comprises a barrel comprising a prepackaged internal pusher cup configured behind the UAV housed within the barrel; an expansion chamber operatively connected around the barrel, wherein the barrel extends out of a first end of the expansion chamber; a muzzle adapter operatively connected to a second end of the expansion chamber, wherein the first end of the expansion chamber is positioned opposite to the second end of the expansion chamber; a rifle operatively connected to the muzzle adapter; and a stand operatively connected to the expansion chamber, wherein a triggering of the rifle causes the internal pusher cup to push the UAV out of the barrel at a predetermined launch velocity in order to attain a predetermined self-propelled flight trajectory.

Preferably, the stand comprises a bipod stand and is attached to the first end of the expansion chamber, and wherein the stand is adapted to support the barrel, expansion chamber, muzzle adapter, and rifle and to orient the barrel at a predetermined elevation angle. The launcher system may further comprise a propulsion source adapted to propel the UAV out of the barrel. Additionally, the propulsion source is adapted to propel up to approximately a 1.5 $lb_m$ UAV at barrel muzzle velocities of approximately 130 ft/s and up to approximately 200 g's of linear forward acceleration, within approximately 30 inches of travel distance of the UAV. Preferably, the rifle comprises any of a M16A2 rifle and a M4 carbine rifle. Additionally, the barrel, the expansion chamber, and the muzzle adapter are dispensable after the UAV is expelled from the barrel. Moreover, the expansion chamber may be concentrically dimensioned and configured to partially envelop the barrel. Alternatively, the expansion chamber may be concentrically dimensioned and configured to fully envelop the barrel. Furthermore, the expansion chamber may comprise a baffle plate dimensioned and configured to reduce barrel pressure and reduce a forward acceleration of the UAV.

Another embodiment provides a system for launching an unmanned projectile, wherein the system comprises a barrel comprising the projectile, a pusher cup positioned behind the projectile, and guide rails adapted to prevent the projectile from rotating in the barrel; an expansion chamber operatively connected around the barrel, wherein the barrel extends out of a front end of the expansion chamber; a muzzle adapter slip-fitted to a back end of the expansion chamber; a rifle operatively connected to the muzzle adapter, wherein the rifle comprises a propulsion source adapted to propel the projectile out of the barrel; and a stand operatively connected to the expansion chamber, wherein a triggering of the rifle causes the pusher cup to push the projectile out of the barrel at a predetermined launch velocity in order to attain a predetermined self-propelled flight trajectory, and wherein the triggering causes the pusher cup to exit the barrel.

Preferably, the stand comprises a bipod stand and is attached to the front end of the expansion chamber, and wherein the stand is adapted to support the barrel, expansion chamber, muzzle adapter, and rifle and to orient the barrel at a predetermined elevation angle. The propulsion source may be adapted to propel up to approximately a 1.5 $lb_m$ projectile at barrel muzzle velocities of approximately 140 ft/s and up to approximately 600 g's of linear forward acceleration, within approximately 30 inches of travel distance of the projectile. Preferably, the rifle comprises any of a M16A2 rifle and a M4 carbine type rifle. Furthermore, the barrel, the expansion chamber, and the muzzle adapter may be dispensable after the projectile is expelled from the barrel. In one embodiment the expansion chamber may be concentrically dimensioned and configured to partially envelop the barrel. Alternatively, the expansion chamber may be concentrically dimensioned and configured to fully envelop the barrel. Moreover, the expansion chamber preferably comprises a baffle plate dimensioned and configured to reduce barrel pressure and reduce a forward acceleration of the projectile.

Another embodiment provides a method of launching unmanned projectiles, wherein the method comprises securing a launcher comprising a projectile to a stably grounded stand, wherein the launcher comprises a barrel comprising a pusher cup positioned behind the projectile; an expansion chamber operatively connected around the barrel; a muzzle adapter operatively connected to the expansion chamber; and a rifle operatively connected to the muzzle adapter. The method further comprises firing the rifle thereby initiating a pyrotechnic event causing a substantially instantaneous increase in pressure in the expansion chamber, and forcing the pusher cup and the projectile to accelerate out of the barrel. Preferably, the increase in the pressure creates a dynamic force applied to an upstream side of the pusher cup causing acceleration of the pusher cup and the projectile. Additionally, the pusher cup preferably has a higher aerodynamic drag and lower inertia than the projectile, wherein as the projectile and the pusher cup exit the barrel, the higher aerodynamic drag and lower inertia of the pusher cup causes a rapid deceleration and separation of the pusher cup from the projectile, thereby allowing the projectile to continue a ballistic flight path prior to transition to a self-propelled flight.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION OF PREFERRED EMBODIMENTS

Figure 1A:
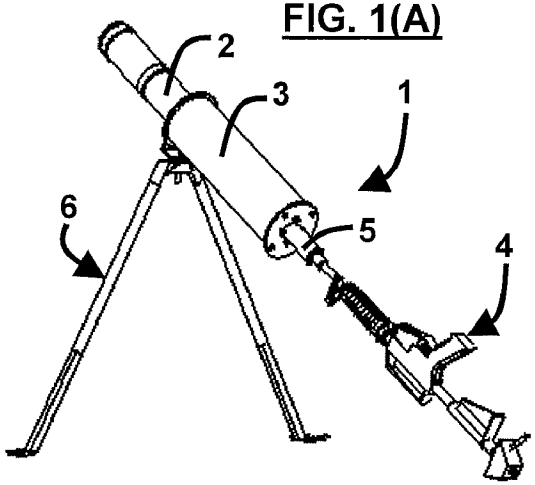
FIG. 1(A) illustrates an isometric view of a rifle launcher according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

As mentioned, there remains a need for a novel weapons launcher for small UAVs capable of being used by one person in a simple and cost effective manner. The embodiments herein achieve this by providing a compact, easy-to-use, and cost-effective rifle launcher for small UAVs that is capable of being used for one-man operation and can be manually set up for firing. Referring now to the drawings, and more particularly to FIGS. 1(A) through 3, where similar reference characters denote corresponding features consistently throughout the figures, there are shown preferred embodiments.

Figure 1C:
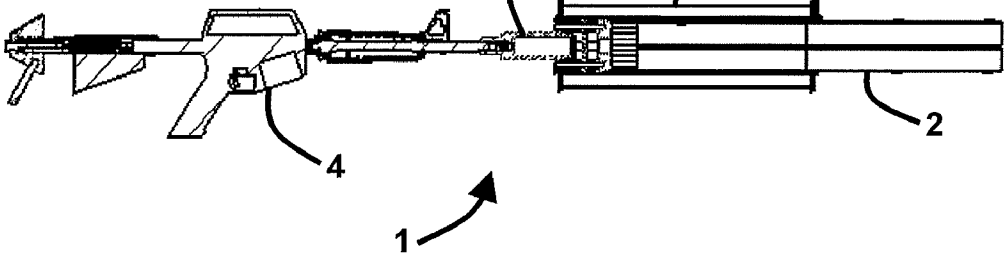
FIG. 1(C) illustrates a cross-sectional view of the rifle launcher of FIG. 1(B) cut along line AA-AA' of FIG. 1(B) without the bipod stand connected according to an embodiment herein.
Figure 1B:
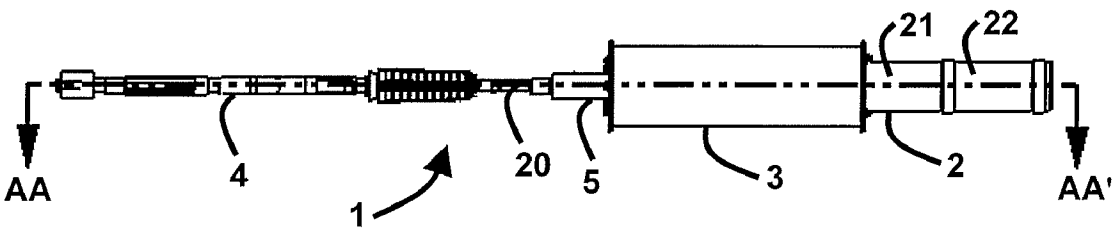
FIG. 1(B) illustrates a top view of the rifle launcher of FIG. 1(A) without the bipod stand connected according to an embodiment herein.
Figure 2:
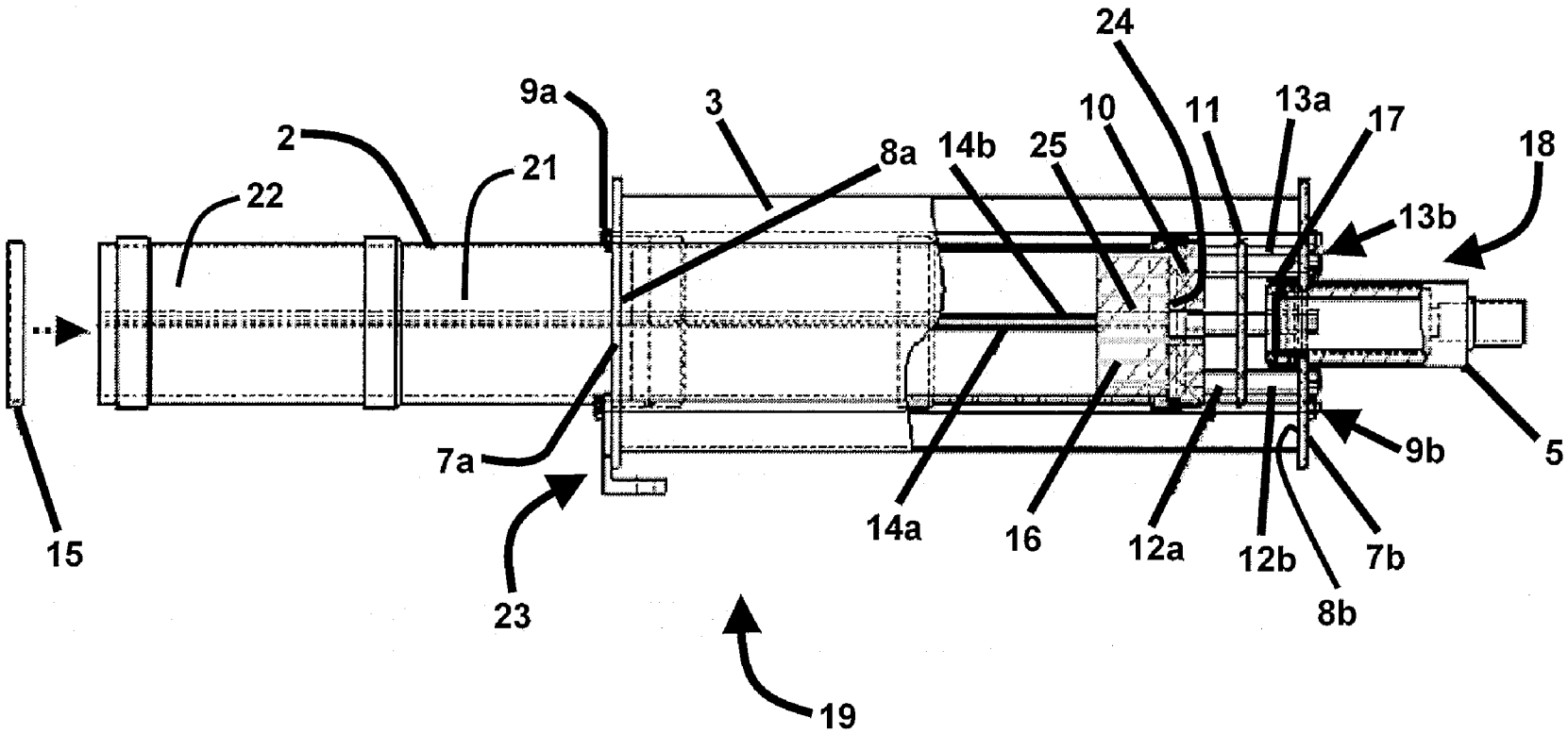
FIG. 2 illustrates a cross-sectional view of the barrel, expansion chamber, and muzzle adapter of the rifle launcher of FIGS. 1(A) through 1(C) according to an embodiment herein.

The launcher 1 shown in FIGS. 1(A) through 2 may be configured with an overall length of approximately 76 inches, and comprises a barrel 2, an expansion chamber 3, a rifle 4, a muzzle adapter 5, and a bipod stand 6. Preferably, the rifle 4 is a M16A2 rifle or a M4 carbine rifle, for example. The barrel 2 is preferably made of a lightweight, high-strength composite, plastic, or metal material and may be configured to be approximately 30 inches long with an inside diameter of less than approximately 3.5 inches. Furthermore, the barrel 2 may comprise shorter sections 21, 22 that are connected together by connecting mechanisms (not shown) such as spring pins. The barrel 2 is affixed to the expansion chamber 3, which preferably has an approximately 6 inch outer diameter. More specifically, the barrel 2 attaches to the expansion chamber 3 via two endplates 7*a*, 7*b*, two gasket seals 8*a*, 8*b* and a plurality of each of bolts 9*a* and nuts 9*b*. The gasket seals 8*a*, 8*b* are sandwiched between barrel 2 and endplates 7*a*, 7*b*. Adapter plate 10, baffle plate 11, a plurality of spacers 12*a*, 12*b*, and a plurality of each of bolts 13*a* and nuts 13*b* are attached to the rear of barrel 2 and endplate 7*b*.

Along the interior length of the barrel 2 are two guide rails 14*a*, 14*b* that prevent projectile rotation and guide a UAV 40 or other projectile (not shown), as it travels down the barrel 2 upon launch. Additionally, the barrel 2 includes a removable, expendable cap 15, a pre-loaded UAV 40, and a plastic or stiff foam pusher cup 16, allowing for easy storage, shipping, and transportation of the launcher 1.

The pusher cup 16 is preferably embodied as a lightweight cup (i.e., piston) that has an outer diameter slightly smaller than the inner diameter of the barrel 2 thereby providing a low friction, pressure-sealing feature. Moreover, the pusher cup 16 is initially positioned behind the UAV (not shown) in the barrel 2 thereby providing a uniform surface for the pressurized gases to act upon it, thereby insuring a consistent and repeatable launch velocity. Furthermore, the pusher cup 16 also has mating guide rail features 25 to interface with the barrel guide rails 14*a*, 14*b* to guide the pusher cup 16 as it travels down the barrel 2. During operation, the pusher cup 16 simply falls away from the UAV a short distance from the barrel 2 upon exit due to its higher drag and much lower mass (compared with the UAV).

The muzzle adapter 5 and nut 17 are affixed to the rear end 18 of the expansion chamber 3. Upon setup, the barrel/expansion chamber/muzzle adapter assembly 19 is manually connected, via slip fit, onto the muzzle 20 of the rifle 4. The bipod stand 6 is attached to the forward end 23 of expansion chamber 3, and supports the launcher 1 on the ground and further orients the launcher 1 at the required elevation angle.

After launching the UAV, the rifle 4 can be readied to fire another UAV simply by replacing the barrel/expansion chamber/barrel adapter assembly 19. In fact, the assembly 19 is intended to be disposable and, depending on the situation, can either be discarded or used again by preparing the assembly 19 with installation of a new or used pusher cup 16, and used, but functional, UAV or other projectile.

The expansion chamber 3 is of concentric design, whereby the barrel 2 is partially-to-fully enveloped by the expansion chamber 3 and the major longitudinal axis of both components (i.e., barrel 2 and expansion chamber 3) are coincident. Both of these features provide for a compact launcher design of reduced length compared with conventional designs. The length and diameter of the expansion chamber 3 can be customized to provide the required launch velocity and peak launch acceleration for a given launch mass, barrel diameter, and barrel length. In other words, the launcher 1 can be easily modified to support the launch of different projectile designs of differing masses and/or diameters. For example, experimental data demonstrates that for a given projectile mass, barrel diameter, and barrel length of 1.5 lbs, 3.5 inches, and 15.5 inches, respectively, the resulting projectile launch velocity and peak acceleration is 130 ft/sec and 200 g's (wherein 1 g=9.8 meters/sec$^2$=Earth's gravitational constant)

respectively, for a chamber length and inside diameter of 19 inches and 5.6 inches respectively.

To setup and operate the launcher 1, first, the bipod stand 6 is extended from the forward end 23 of barrel/expansion chamber/muzzle adapter assembly 19 (including an enclosed UAV and pusher cup 16) and placed on the ground while the assembly 19 is manually attached to the muzzle 20 of a rifle 4, such as a M16A2 rifle or a M4 carbine rifle, for example. The complete assembly 19, rifle 4, and bipod stand 6 is oriented and secured on the ground. To fire the launcher 1, a standard military M195 blank cartridge is chambered in the rifle 4 and the rifle 4 is cocked. The manual trigger firing of the rifle 4 initiates the pyrotechnic event causing an almost instantaneous increase in pressure in the expansion chamber 3. As the pressure builds, a dynamic force is applied to the upstream side 24 of the pusher cup 16 and both the pusher cup 16 and UAV begin accelerating down the barrel 2. As the UAV and pusher cup 16 exit the barrel 2, the higher aerodynamic drag and lower inertia of the pusher cup 16 causes the rapid deceleration and separation of the pusher cup 16 from the UAV (or other type projectile), thus allowing the UAV to continue its ballistic flight path prior to its transition to self-propelled flight.

The launcher 1 provided by the embodiments herein offers a compact design, ease of use, use of a commonly-available, military type-classified, and cost effective propulsion sources, and its design allows simple, one-man, manual setup, and firing. Moreover, the launcher 1 provides an instantaneous source of propulsion gas in the expansion chamber 3 (created by a very small compact energetic-material-based ammunition cartridge (not shown) that is located inside the rifle 4) unique in application to launching small UAV's at relatively low setback accelerations and at relatively high muzzle velocities within relatively short barrel travel distances. Furthermore, the relatively quick setup and subsequent launch method provided by the embodiments herein utilizes a pre-packaged UAV and pusher cup 16 within an assembly 19 that is dispensable after the UAV is deployed.

Figure 3:
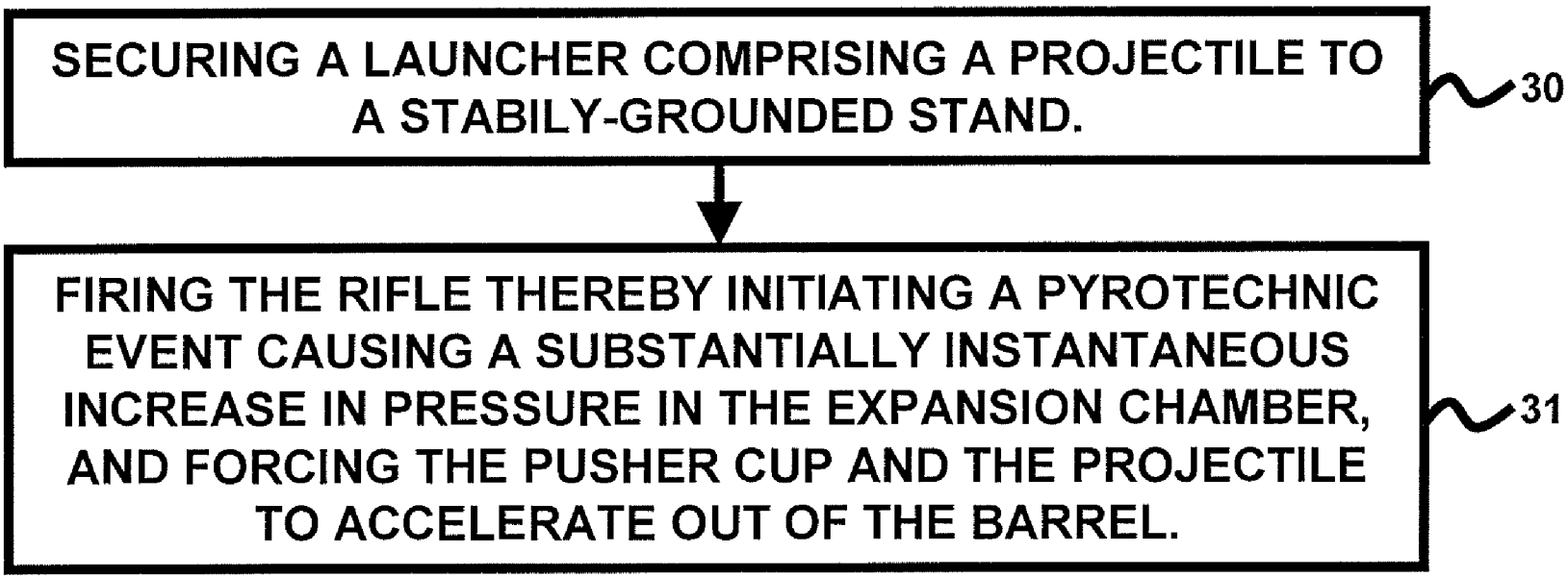
FIG. 3 is a flow diagram illustrating a preferred method according to an embodiment herein.
Figure 4:
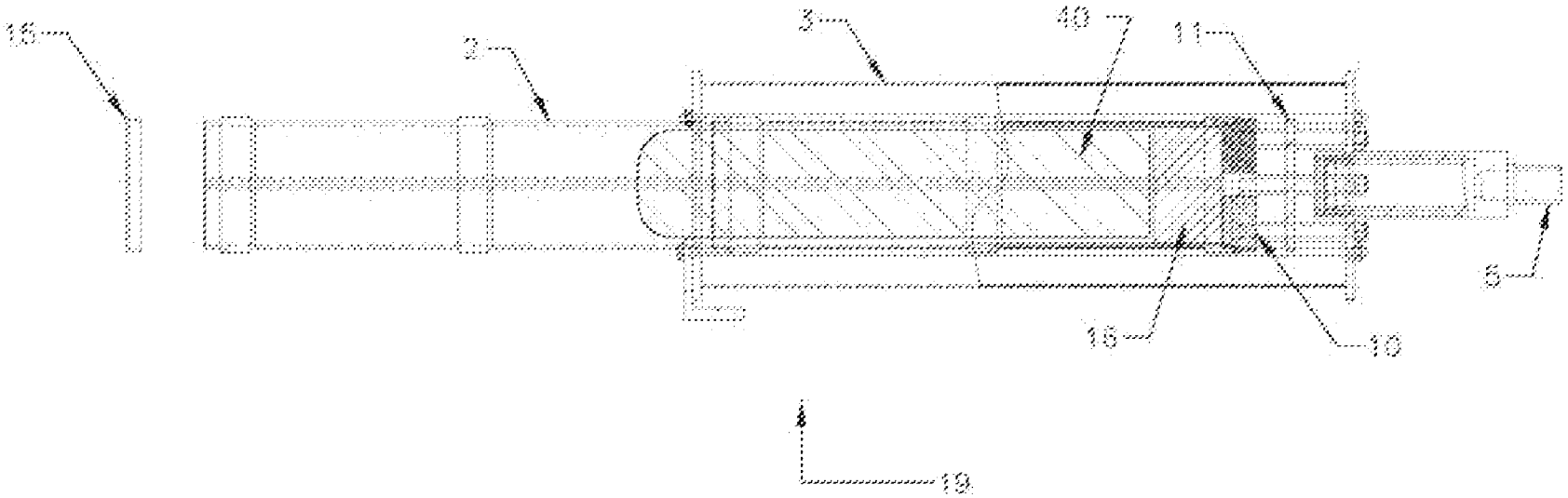
FIG. 4 illustrates the barrel, UAV, and muzzle adapter in combination.

FIG. 3, with reference to FIGS. 1(A) through 2, illustrates a method of launching an unmanned projectile such as a UAV according to an embodiment herein. The method comprises securing (30) a launcher 1 comprising a projectile (not shown) to a stabily-grounded stand 6, wherein the launcher 1 comprises a barrel 2 comprising a pusher cup 16 positioned behind the projectile (not shown); an expansion chamber 3 operatively connected around the barrel 2; a muzzle adapter 5 operatively connected to the expansion chamber 3; and a rifle 4 operatively connected to the muzzle adapter 5. The method further comprises firing (31) the rifle 4 thereby initiating a pyrotechnic event causing a substantially instantaneous increase in pressure in the expansion chamber 3, and forcing the pusher cup 16 and the projectile to accelerate out of the barrel 2. Preferably, the increase in the pressure creates a dynamic force applied to an upstream side 24 of the pusher cup 16 causing acceleration of the pusher cup 16 and the projectile. Additionally, the pusher cup 16 preferably has a higher aerodynamic drag and lower inertia than the projectile, wherein as the projectile and the pusher cup 16 exit the barrel 2, the higher aerodynamic drag and lower inertia of the pusher cup 16 causes a rapid deceleration and separation of the pusher cup 16 from the projectile, thereby allowing the projectile to continue a ballistic flight path prior to transition to a self-propelled flight.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A launcher system for attaching to a rifle and launching an unmanned aerial vehicle (UAV), said launcher system comprising:

a barrel comprising a UAV and a pusher cup configured behind said UAV housed within said barrel;

an expansion chamber operatively connected to said barrel and disposed around at least a portion of said barrel, wherein said barrel extends out of a first end of said expansion chamber; and a muzzle adapter operatively connected to a second end of said expansion chamber, wherein said first end of said expansion chamber is positioned opposite to said second end of said expansion chamber;

said muzzle adapter configured to operatively and removably attach said launcher system to the barrel of a rifle;

wherein a triggering of an explosive event in said rifle causes said pusher cup to push said UAV out of said barrel in order to attain a self-propelled flight trajectory after which said launcher system can be removed from said barrel of said rifle.

2. The launcher system of claim 1, wherein said stand comprises a bipod stand and is attached to said first end of said expansion chamber, and wherein said stand is adapted to support said barrel, expansion chamber, muzzle adapter, and rifle and to orient said barrel at a predetermined elevation angle.

3. The launcher system of claim 1, further comprising a cap.

4. The launcher system of claim 3, wherein said propulsion source is adapted to propel up to approximately a 1.5 $lb_m$ UAV at barrel muzzle velocities of approximately 130 ft/s and up to approximately 200 g's of linear forward acceleration, within approximately 30 inches of travel distance of said UAV.

5. The launcher system of claim 1, wherein said rifle comprises any of a M16A2 rifle and a M4 carbine rifle.

6. The launcher system of claim 1, wherein said barrel, said expansion chamber, and said muzzle adapter are dispensable after said UAV is expelled from said barrel.

7. The launcher system of claim 1, wherein said expansion chamber is concentrically dimensioned and configured to partially envelop said barrel of said launcher and is attached to the barrel of a rifle such that the expansion chamber and the barrel of the launcher system is concentric with the barrel of the rifle to which the device is attached.

8. The launcher system of claim 1, wherein said expansion chamber is concentrically dimensioned and configured to fully envelop said barrel of said launcher and is attached to the barrel of a rifle such that the expansion chamber and the barrel of the launcher system is concentric with the barrel of the rifle to which the device is attached.

9. The launcher system of claim 1, wherein said expansion chamber comprises a baffle plate dimensioned and configured to reduce barrel pressure and reduce a forward acceleration of said UAV.

10. A system for launching an unmanned aerial vehicle, said system comprising:

a barrel comprising an unmanned aerial vehicle and a pusher cup positioned behind said unmanned aerial vehicle;

guide rails adapted to prevent said unmanned aerial vehicle from rotating in said barrel;

an expansion chamber operatively connected to said barrel and disposed around at least a portion of said barrel, wherein said barrel extends out of a front end of said expansion chamber;

a muzzle adapter attached to a back end of said expansion chamber;

a rifle slip-fitted to said muzzle adapter, wherein said rifle comprises a propulsion source adapted to propel said unmanned aerial vehicle out of said barrel; and a stand operatively connected to said expansion chamber, wherein a triggering of said rifle causes said pusher cup to push said unmanned aerial vehicle out of said barrel at a predetermined launch velocity in order to attain a predetermined self-propelled flight trajectory, and wherein said triggering causes said pusher cup to exit said barrel.

11. The system of claim 10, wherein said stand comprises a bipod stand and is attached to said front end of said expansion chamber, and wherein said stand is adapted to support said barrel, expansion chamber, muzzle adapter, and rifle and to orient said barrel at a predetermined elevation angle.

12. The system of claim 10, wherein said propulsion source is adapted to propel up to approximately a 1.5 $lb_m$ projectile at barrel muzzle velocities of approximately 130 ft/s and up to approximately 200 g's of linear forward acceleration, within approximately 30 inches of travel distance of said projectile.

13. The system of claim 10, wherein said rifle comprises any of a M16A2 rifle and a M4 carbine rifle.

14. The system of claim 10, wherein said barrel, said expansion chamber, and said muzzle adapter are dispensable after said projectile is expelled from said barrel.

15. The system of claim 10, wherein said expansion chamber is concentrically dimensioned and configured to partially or fully envelop said barrel.

16. The system of claim 10, further comprising a cap.

17. The system of claim 10, wherein said expansion chamber comprises a baffle plate dimensioned and configured to reduce barrel pressure and reduce a forward acceleration of said projectile.

18. A method of launching an unmanned aerial vehicle (UAV), said method comprising:

securing a prepackaged launcher assembly that comprises a unmanned aerial vehicle (UAV) to a stand, wherein said launcher further comprises:

a barrel comprising a pusher cup positioned behind said unmanned aerial vehicle (UAV);

an expansion chamber operatively connected to and said barrel and disposed around at least a portion of said barrel;

a muzzle adapter operatively connected to said expansion chamber; and a rifle operatively connected to said muzzle adapter;

firing said rifle thereby initiating a pyrotechnic event causing a substantially instantaneous increase in pressure in said expansion chamber, and forcing said pusher cup and said unmanned aerial vehicle to accelerate out of said barrel.

19. The method of claim 18, wherein said muzzle adapter is connected to said rifle such that muzzle adapter, the expansion chamber and the barrel of the launcher are concentric with the barrel of the rifle.

20. The method of claim 18, wherein said pusher cup has a higher aerodynamic drag and lower inertia than said unmanned aerial vehicle (UAV), and wherein as said projectile and said pusher cup exit said barrel, the higher aerodynamic drag and lower inertia of said pusher cup causes a rapid deceleration and separation of said pusher cup from said unmanned aerial vehicle (UAV), thereby allowing said unmanned aerial vehicle (UAV) to continue a ballistic flight path prior to transition to a self-propelled flight.

* * * * *